US008657636B2

(12) United States Patent
Wu

(10) Patent No.: US 8,657,636 B2
(45) Date of Patent: Feb. 25, 2014

(54) METAL CLAMP

(75) Inventor: Shang Tsai Wu, New Taipei (TW)

(73) Assignee: Dinkle Enterprise Co., Ltd, New Taipei (TW)

( * ) Notice: Subject to any disclaimer, the term of this patent is extended or adjusted under 35 U.S.C. 154(b) by 52 days.

(21) Appl. No.: 13/430,094

(22) Filed: Mar. 26, 2012

(65) Prior Publication Data

US 2013/0252487 A1 Sep. 26, 2013

(51) Int. Cl.
*H01R 12/00* (2006.01)

(52) U.S. Cl.
USPC ..... 439/862

(58) Field of Classification Search
USPC ..... 439/862, 66, 71, 78, 74, 65
See application file for complete search history.

(56) References Cited

U.S. PATENT DOCUMENTS 6,296,495 B1 * 10/2001 Wang et al. ..... 439/71
6,551,149 B2 * 4/2003 Orihara ..... 439/862
7,500,857 B2 * 3/2009 Schmid et al. ..... 439/78
7,544,104 B2 * 6/2009 Fan et al. ..... 439/722
7,775,805 B2 * 8/2010 Liao et al. ..... 439/66
7,802,994 B1 * 9/2010 Chen et al. ..... 439/65
8,070,498 B2 * 12/2011 Shen ..... 439/66
8,092,236 B2 * 1/2012 Yang et al. ..... 439/83
8,298,021 B2 * 10/2012 Huang et al. ..... 439/862

* cited by examiner

*Primary Examiner* — Alexander Gilman
(74) *Attorney, Agent, or Firm* — Bacon & Thomas, PLLC

(57) ABSTRACT

A metal clamp is formed as a one-piece integral having a lower part and an upper part that border on each other. The upper part has two transversely extending terminal pins and the lower part is formed as a U-shaped structure that includes a first clamping arm, a second clamping arm and a third clamping arm that extend vertically. The first clamping arm and the second clamping arm face each other across an accommodating gap defined therebetween. The third clamping arm is resiliently restorable and is deposited between the first clamping arm and the second clamping arm to face the accommodating gap. The metal clamp provides good electrical contact.

4 Claims, 5 Drawing Sheets

METAL CLAMP

BACKGROUND OF THE INVENTION

1. Technical Field

The present invention relates to a metal clamp enabling electrical contact.

2. Description of Related Art

In electronic devices, there are usually metal clamps for clamping electric wires or other electronic components so as to provide (electrical) connection as desired.

Please refer to FIG. 1 and FIG. 2 together. FIG. 1 is a perspective view of a conventional metal clamp, and FIG. 2 is another perspective view of the conventional metal clamp taken from another viewpoint.

As shown in FIG. 1 and FIG. 2, the conventional metal clamp 9 has two transversely extending clamping arms 91.

As shown, the two clamping arms 91 of the metal clamp 9 face each other. In other words, the two clamping arms 91 use their planes parallel to each other to clamp an external object (not shown) therebetween.

However, such a conventional metal clamp 9 has the defect that the object clamped tends to escape from the two clamping arms 91, so the clamping efficiency and, in turn, the electrical contact is not ideal.

SUMMARY OF THE INVENTION

According to the present invention, a metal clamp is formed as a one-piece integral having a lower part and an upper part that border on each other. The upper part has two transversely extending terminal pins and the lower part is formed as an U-shaped structure that includes a first clamping arm, a second clamping arm and a third clamping arm that extend vertically. The first clamping arm and the second clamping arm face each other across an accommodating gap defined therebetween. The third clamping arm is resiliently restorable and is deposited between the first clamping arm and the second clamping arm to face the accommodating gap.

With the foregoing configuration, namely the U-shaped lower part having the first clamping arm and the second clamping arm facing each other across the accommodating gap and the third clamping arm being resiliently restorable and being deposited between the first clamping arm and the second clamping arm to face the accommodating gap, the metal clamp provides good electrical contact.

The third clamping arm has a tilted lower end.

BRIEF DESCRIPTION OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE INVENTION

Figure 1:
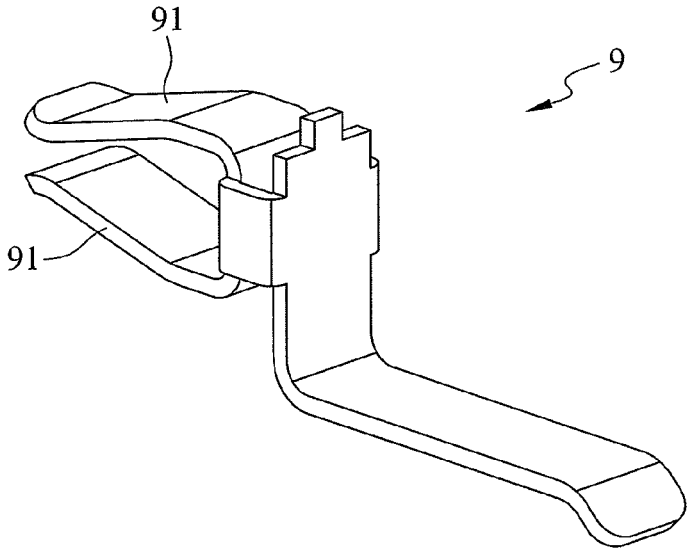
FIG. 1 (PRIOR ART)
FIG. 1 is a perspective view of a conventional metal clamp.
Figure 2:
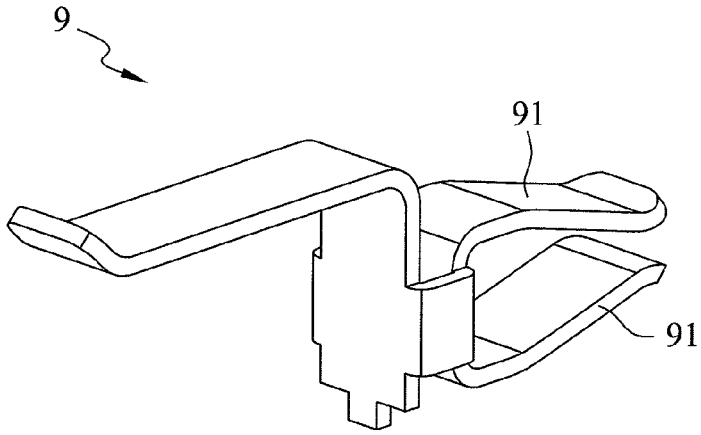
FIG. 2 (PRIOR ART)
FIG. 2 is another perspective view of the conventional metal clamp taken from another viewpoint.
Figure 3:
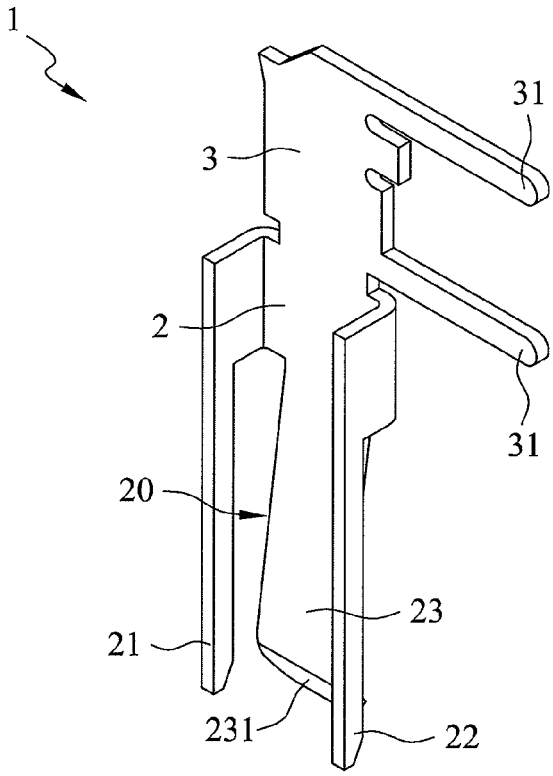
FIG. 3 is a perspective view of a metal clamp according to one preferred embodiment of the present invention.
Figure 4:
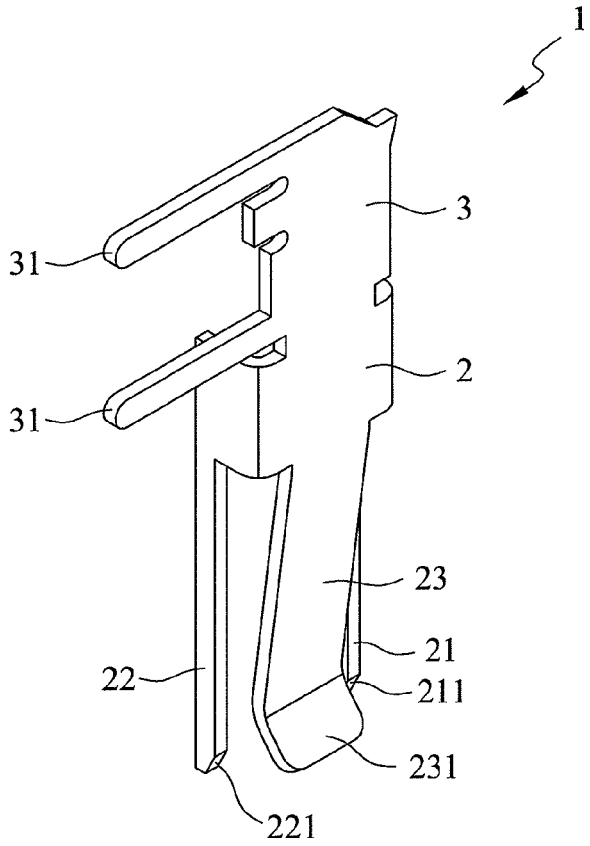
FIG. 4 is another perspective view of the metal clamp according to one preferred embodiment of the present invention taken from another viewpoint.

Please refer to FIG. 3 and FIG. 4 together. FIG. 3 is a perspective view of a metal clamp according to one preferred embodiment of the present invention, and FIG. 4 is another perspective view of the metal clamp according to one preferred embodiment of the present invention taken from another viewpoint.

As shown in the drawings, the inventive metal clamp 1 is formed as a one-piece integral having a lower part 2 and an upper part 3 that border on each other. The upper part 3 has two transversely extending terminal pins 31 and the lower part 2 is formed as an U-shaped structure that includes a first clamping arm 21, a second clamping arm 22 and a third clamping arm 23 that extend vertically. The first clamping arm 21 and the second clamping arm 22 face each other across an accommodating gap 20 defined therebetween. The third clamping arm 23 is resiliently restorable and is deposited between the first clamping arm 21 and the second clamping arm 22 to face the accommodating gap 20.

Figure 5:
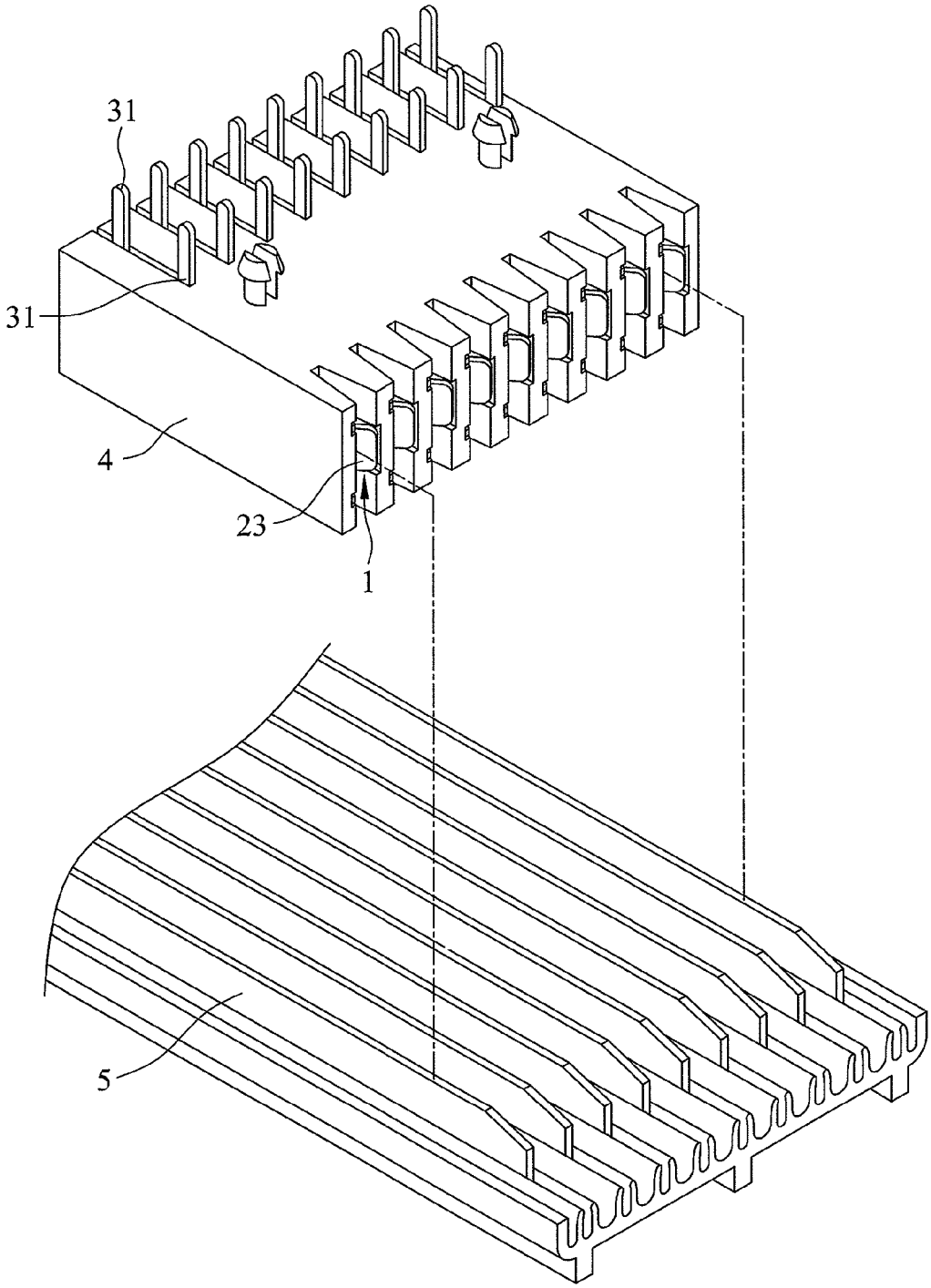
FIG. 5 is an applied view of the metal clamps according to the present invention.

Please refer to FIG. 5, which is an applied view of the metal clamps according to the present invention, while seeing also FIG. 3 and FIG. 4.

As shown in FIG. 5, plural said metal clamps 1 are mounted on a base 4, and an to-be-clamped object 5 (such as each of metal plates shown in FIG. 5) may be inserted into and clamped by the metal clamp 1. When mounted on the base 4, the metal clamp 1 has the first clamping arm 21 and the second clamping arm 22 of the lower part 2 working as a fixed side. Thereby, when the to-be-clamped object 5 is inserted into the accommodating gap 20 at the lower part 2 of the metal clamp 1, the resiliently restorable third clamping arm 23 serves to apply a force to push the to-be-clamped object 5 (i.e. the metal plate) toward the fixed side, so as to clamp the object 5 with improved firmness. Thereby, the object 5 retained by the first clamping arm 21, the second clamping arm 22 and the third clamping arm 23 of the lower part 2 is unlikely to escape from the accommodating gap 20.

With the foregoing configuration, namely the U-shaped lower part 2 having the first clamping arm 21 and the second clamping arm 22 facing each other across the accommodating gap 20 and the resiliently restorable third clamping arm 23 deposited between the first clamping arm 21 and the second clamping arm 22 to face the accommodating gap 20, the metal clamp 1 provides strong clamping force and, in turn, good electrical contact.

In the depicted embodiment, the third clamping arm 23 has a tilted lower end 231 as a bent portion. When the to-be-clamped object 5 is inserted into the accommodating gap 20 at the lower part 2 of the metal clamp 1, the tilted lower end 231 serves as a guide to facilitate smooth entry of the object 5.

In addition, as can be seen in FIG. 4, the first clamping arm 21 of the lower part 2 may have a chamfered lower end 211. Similarly, the second clamping arm 22 of the lower part 2 may also have a chamfered lower end 221. Thereby, insertion of the to-be-clamped object 5 to the metal clamp 1 can be further facilitated.

What is claimed is:

1. A metal clamp being formed as a one-piece integral having a lower part and an upper part that are formed in a substantially same plane and border on each other, the upper part having two terminal pins extending transversely therefrom and coplanar with said plane, the lower part being formed as an U-shaped structure that includes a first clamping arm, a second clamping arm and a third clamping arm that extend vertically along said plane, the first clamping arm and the second clamping arm facing each other across an accommodating gap therebetween, and the third clamping arm being resiliently restorable and being deposited between the first clamping arm and the second clamping arm to face the accommodating gap, while leaving the accommodating gap open.

2. The metal clamp of claim 1, wherein the first clamping arm has a chamfered lower end.

3. The metal clamp of claim 1, wherein the second clamping arm has a chamfered lower end.

4. The metal clamp of claim 1, wherein the third clamping arm has a tilted lower end to introduce an object to be clamped into the accommodating gap.

* * * * *